US008227987B2

(12) United States Patent
Lee et al.

(10) Patent No.: US 8,227,987 B2
(45) Date of Patent: Jul. 24, 2012

(54) PROTECTING LAYER HAVING MAGNESIUM OXIDE PARTICLES AT ITS SURFACE, METHOD OF PREPARING THE SAME, AND PLASMA DISPLAY PANEL COMPRISING THE PROTECTING LAYER

(75) Inventors: Min-Suk Lee, Suwon-si (KR); Jong-Seo Choi, Suwon-si (KR); Suk-Ki Kim, Suwon-si (KR); Yury Matulevich, Suwon-si (KR); Jae-Hyuk Kim, Suwon-si (KR); Soon-Sung Suh, Suwon-si (KR); Hee-Young Chu, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 475 days.

(21) Appl. No.: 12/314,604

(22) Filed: Dec. 12, 2008

(65) Prior Publication Data

US 2009/0153019 A1 Jun. 18, 2009

(30) Foreign Application Priority Data

Dec. 14, 2007 (KR) ..... 10-2007-0130978

(51) Int. Cl.
*H01J 17/49* (2012.01)

(52) U.S. Cl. ..... 313/586; 313/582

(58) Field of Classification Search ..... 313/582–587; 315/169.4; 345/37, 41, 60–72
See application file for complete search history.

(56) References Cited

U.S. PATENT DOCUMENTS

| | | | | |
|---|---|---|---|---|
| 7,166,961 | B2 * | 1/2007 | Park | 313/587 |
| 7,253,561 | B2 * | 8/2007 | Kim et al. | 313/587 |
| 2001/0050528 | A1 * | 12/2001 | Sawada et al. | 313/486 |
| 2002/0074623 | A1 * | 6/2002 | Sakurai et al. | 257/632 |
| 2004/0145316 | A1 * | 7/2004 | Nishitani et al. | 313/587 |
| 2005/0264487 | A1 * | 12/2005 | Tokunaga et al. | 345/63 |
| 2006/0012721 | A1 * | 1/2006 | Morita et al. | 348/739 |
| 2006/0055325 | A1 * | 3/2006 | Hirota et al. | 313/587 |
| 2006/0134437 | A1 | 6/2006 | Lee et al. | |
| 2006/0284559 | A1 * | 12/2006 | Naoi et al. | 313/586 |

(Continued)

FOREIGN PATENT DOCUMENTS

EP 1-564-777 A1 8/2005

(Continued)

OTHER PUBLICATIONS

European Examination Report issued by the European Patent office, dated Jan. 24, 2011, corresponding to European Patent Application No. 08 254 008.9-2208.

(Continued)

*Primary Examiner* — Nimeshkumar Patel
*Assistant Examiner* — Christopher Raabe
(74) *Attorney, Agent, or Firm* — Robert E. Bushnell, Esq.

(57) ABSTRACT

Provided are a protecting layer for a plasma display panel (PDP), a method of forming the same, and a PDP including the protecting layer. The protecting layer includes a magnesium oxide-containing layer having a surface to which magnesium oxide-containing particles having a magnesium vacancy-impurity center (VIC) are attached. The protecting layer is resistant to plasma ions and has excellent electron emission effects, and thus, a PDP including the protecting layer can be operated at low voltage with high discharge efficiency.

19 Claims, 10 Drawing Sheets

U.S. PATENT DOCUMENTS

| | | | | |
|---|---|---|---|---|
| 2007/0001601 | A1 | 1/2007 | Nishitani et al. | |
| 2007/0013306 | A1 | 1/2007 | Hai et al. | |
| 2007/0080641 | A1* | 4/2007 | Yamamoto | 313/586 |
| 2007/0096653 | A1 | 5/2007 | Jeong et al. | |
| 2007/0126361 | A1 | 6/2007 | Lee | |
| 2007/0281185 | A1* | 12/2007 | Sakurai et al. | 428/702 |
| 2008/0157671 | A1* | 7/2008 | Naoi et al. | 313/586 |
| 2008/0157673 | A1* | 7/2008 | Fukui et al. | 313/587 |
| 2009/0167176 | A1 | 7/2009 | Fukui et al. | |

FOREIGN PATENT DOCUMENTS

| | | | |
|---|---|---|---|
| EP | 1-833-070 | A2 | 9/2007 |
| JP | 200659780 | A | 3/2006 |
| JP | 2006169636 | A | 6/2006 |
| JP | 2007128894 | A | 5/2007 |
| JP | 2007-184264 | | 7/2007 |
| JP | 2007280730 | A | 10/2007 |
| KR | 10-2005-0073531 | | 7/2005 |
| KR | 1020070074123 | A | 7/2007 |
| KR | 1020070092622 | A | 9/2007 |
| WO | 2005043578 | A1 | 5/2005 |
| WO | 2007/126061 | A1 | 11/2007 |

OTHER PUBLICATIONS

Transmitter letter and Korean Office Action issued on Jul. 17, 2009 in the corresponding Korean Patent Application No. 10-2007-0130978.

European Search Report issued on Jul. 17, 2009 by European Patent Office.

Japanese Office Action issued by Japanese Patent Office on Jul. 19, 2011, corresponding to Japanese Patent Application No. 2008-318440 and Request for Entry of the Accompanying Office Action attached herewith.

Chinese Office Action issued by the Chinese Patent Office on Jun. 21, 2011 in the corresponding Chinese patent application No. 200810183768.1. English translation provided herewith.

* cited by examiner

PROTECTING LAYER HAVING MAGNESIUM OXIDE PARTICLES AT ITS SURFACE, METHOD OF PREPARING THE SAME, AND PLASMA DISPLAY PANEL COMPRISING THE PROTECTING LAYER

CLAIM OF PRIORITY

This application makes reference to, incorporates the same herein, and claims all benefits accruing under 35 U.S.C. §119 from an application for PROTECTING LAYER HAVING MAGNESIUM OXIDE PARTICLES AT ITS SURFACE, METHOD OF PREPARING THE SAME, AND PLASMA DISPLAY PANEL COMPRISING THE PROTECTING LAYER earlier filed in the Korean Intellectual Property Office on the Dec. 14, 2007 and there duly assigned Serial No. 10-2007-0130978.

BACKGROUND OF THE INVENTION

1. Field of the Invention

The present invention relates to a protecting layer of a plasma display panel, a method of preparing the protecting layer, and a plasma display panel including the protecting layer, and more particularly, to a protecting layer comprising a magnesium oxide-containing layer having a surface to which magnesium oxide-containing particles having a magnesium vacancy-impurity center (VIC) are attached, a method of preparing the protecting layer, and a plasma display panel (PDP) including the protecting layer. This protecting layer having magnesium oxide particles at its surface is hardly damaged by plasma ions and has excellent electron emission performance, and thus, a PDP including the protecting layer has high reliability.

2. Description of the Related Art

Plasma display panels (PDPs) are self-emission devices that can be easily manufactured in a large size, and have good display quality and rapid response time. PDPs can also be manufactured to be thin, and thus, like LCDs, are suitable for wall displays.

FIG. 1 is a vertical cross-sectional view of a pixel portion of a PDP. Referring to FIG. 1, sustain electrodes 15, each including a transparent electrode 15*a* and a bus electrode 15*b* made of a metal, are formed on an inner surface of a front substrate 14. A first dielectric layer 16 is formed on the sustain electrodes 15. When the first dielectric layer 16 is directly exposed to a discharge space, discharging properties can be degraded and lifetime can be reduced. Therefore, a protecting layer 17 is formed on the first dielectric layer 16.

Meanwhile, an address electrode 11 is formed on a second substrate 10, and the address electrode 11 is covered by a second dielectric layer 12. The first substrate 14 and the second substrate 10 face each other, and are separated from each other by a predetermined distance. Barrier ribs 19 are interposed between the first substrate 14 and the second substrate 10 to define a discharge cell. A phosphor layer 13 is formed in the discharge cell. A gaseous mixture which generates ultraviolet rays is filled in the discharge cell. The gaseous mixture can be a mixture of Ne and Xe, or a gaseous mixture of He, Ne, and Xe at a predetermined pressure, for example, 450 Torr, in which Xe generates vacuum ultraviolet (VUV) rays (Xe ion: 147 nm of atomic rays; and $Xe_2$: 173 nm of molecular rays), Ne reduces and stabilizes a discharge initiation voltage, and He increases mobility of Xe and increases emission of the molecular rays of Xe of 173 nm.

Generally, a protective layer of a PDP performs the following three functions.

First, a protecting layer protects an electrode and a dielectric layer. Discharging occurs even when only an electrode or a dielectric layer and an electrode are used. When only an electrode is used, it may be difficult to control a discharge current. When only a dielectric layer and an electrode are used, damage to the dielectric layer by sputtering may occur. Thus, the dielectric layer must be coated with a protective layer resistant to plasma ions.

Second, a protecting layer reduces a discharge initiation voltage. A discharge initiation voltage is directly correlated with the coefficient of secondary electron emission from a material constituting the protective layer against plasma ions. As more secondary electrons are emitted from the protecting layer, the discharge initiation voltage is reduced. In this regard, it is preferable to form a protective layer using a material with a high secondary electron emission coefficient.

Finally, a protecting layer reduces a discharge delay time. The discharge delay time refers to time needed to initiate discharge after a voltage is applied. The discharge delay time is the sum of a formation delay time Tf and a statistic delay time Ts. The formation delay time Tf is a time interval between the time when a voltage is applied and the time when a discharge current is generated, and the statistical delay time Ts is a statistical distribution of the formation delay time. The shorter the discharge delay time Tf is, the faster addressing is performed for a single scan method. Further, a shorter discharge delay time Tf can reduce scan drive costs, increase the number of sub-fields, and improve brightness and image quality.

A conventional protecting layer for a PDP can be formed by depositing a mono-crystalline magnesium oxide or a poly-crystalline magnesium oxide on a substrate (see KR 2005-0073531). However, a PDP having such a conventional protecting layer has a high operating voltage, high power consumption, and long discharge delay time, and thus the conventional protecting layer is unsuitable for a HD PDP using a single scan method. Therefore, there is a need to develop a protecting layer with improved characteristics.

SUMMARY OF THE INVENTION

The present invention provides a protecting layer that substantially prevents damages caused by plasma ions and has excellent electron emission effects, a method of preparing the same, and a plasma display panel (PDP) including the protecting layer.

According to an aspect of the present invention, there is provided a protecting layer for a PDP, the protecting layer including a magnesium oxide-containing layer, and magnesium oxide-containing particles formed on a surface of the magnesium oxide-containing layer. The magnesium oxide-containing particles have a magnesium vacancy-impurity center (VIC).

A cathodoluminescence (CL) emission spectrum of the magnesium oxide containing particles may have a peak from VIC in the range of 3.1 eV to 6 eV. The cathodoluminescence (CL) emission spectrum of the magnesium oxide containing particles may have a peak from VIC in the range of 3.1 eV to 4.2 eV. The cathodoluminescence (CL) emission spectrum of the magnesium oxide containing particles may have a peak from VIC in the range of 3.35 eV to 3.87 eV The magnesium oxide containing layer may further include a rare earth element. The magnesium oxide containing layer may further include Al, Ca, or Si. The magnesium oxide containing particles may further include a rare earth element. The magnesium oxide containing particles may further include Al, Ca, or Si. The magnesium oxide containing particles further comprise scandium (Sc).

According to another aspect of the present invention, there is provided a method of forming a protecting layer for a PDP, the method including forming a magnesium oxide-containing layer on a substrate, preparing magnesium oxide-containing particles, and attaching the magnesium oxide-containing particles to a surface of the magnesium oxide-containing layer.

According to another aspect of the present invention, there is provided a PDP including the protecting layer having magnesium oxide particles at its surface.

The protecting layer having magnesium oxide particles at its surface is substantially not damaged by a plasma ion and has excellent electron emission performances. Therefore, the PDP including the protecting layer has high reliability.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicated the same or similar components, wherein.

DETAILED DESCRIPTION OF THE INVENTION

The present invention will now be described more fully with reference to the accompanying drawings, in which exemplary embodiments of the invention are shown.

A protecting layer for a PDP according to the present invention includes a magnesium oxide-containing layer having a surface to which magnesium oxide-containing particles are attached.

The magnesium oxide-containing particles at the surface of the magnesium oxide-containing layer have a magnesium vacancy-impurity center (VIC). As a result, more secondary electrons can be emitted when a PDP including the protecting layer is operated. The magnesium vacancy-impurity center (VIC) may be generally understood to indicate an excited state made by an interaction between a donor state formed in a band gap of magnesium oxide (impurity) and an acceptor state (magnesium vacancy).

Unlike a magnesium oxide layer, VIC-containing magnesium oxide particles have VIC. The structural difference between magnesium oxide particles and a magnesium oxide layer can be identified through a cathodoluminescence (CL) emission spectrum. In a CL spectrum of a magnesium oxide layer, an emission peak related to an F center or F+ center appears between 2.3 eV and 3.1 eV. F center or F+ center is formed as a result of vacancy of oxygen. When there are two trap electrons, an F center (about 2.3 eV) emission occurs; on the other hand, when there is only one trap electron, an F+ center (about 3.1 eV) emission occurs. In general, in an emission spectrum of a magnesium oxide layer, an emission peak related to the magnesium VIC is not shown. Although not limited to a specific principle, such result may be due to the fact that the magnesium oxide layer is formed using a deposition method such as an e-beam deposition method or a plasma deposition method, which is performed under oxygen-poor conditions, and thus, VIC is not formed in the magnesium oxide layer.

Figure 1:
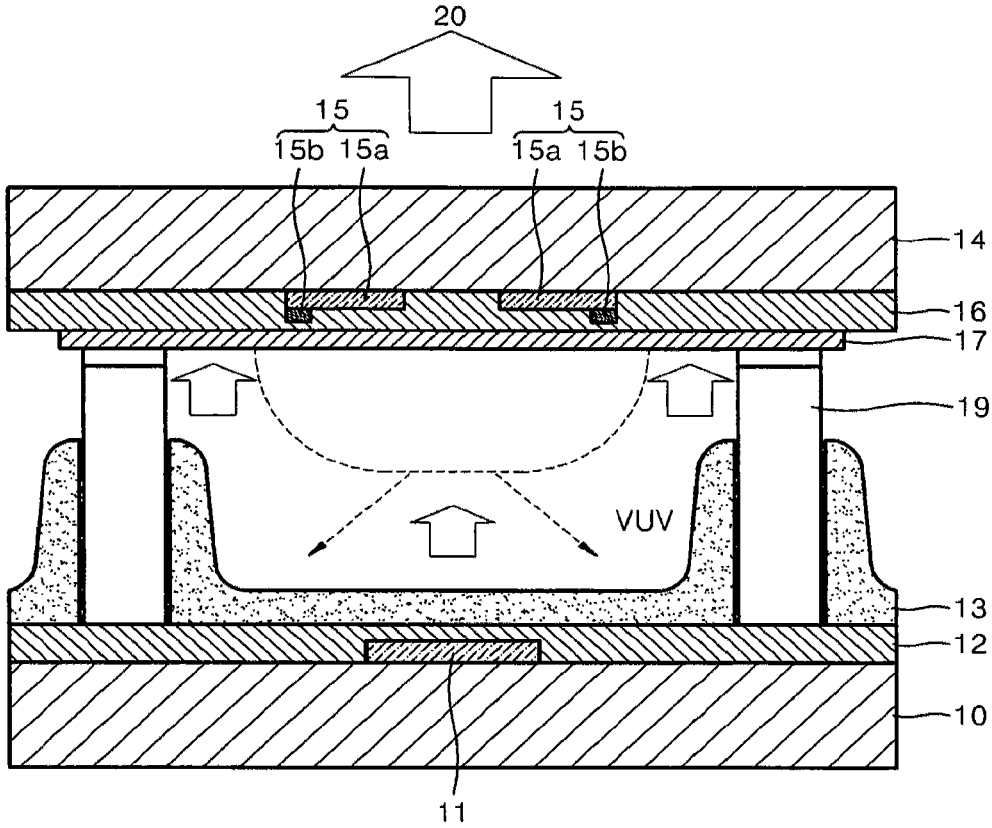
FIG. 1 is a vertical cross-sectional view of a pixel of a plasma display panel (PDP)
Figure 2:
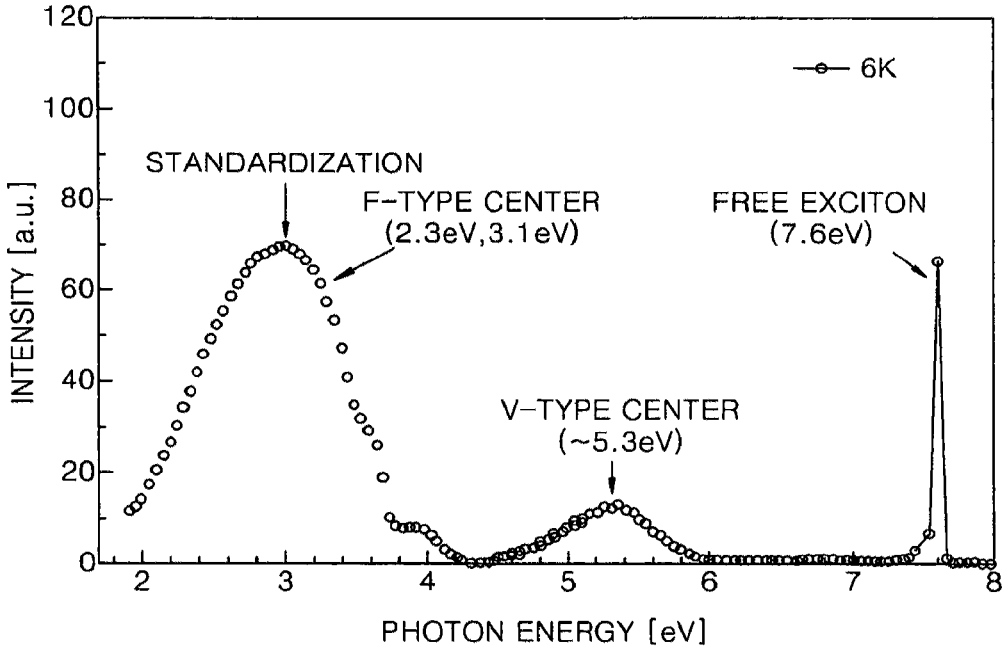
FIG. 2 illustrates a cathodoluminescence (CL) emission spectrum of mono-crystalline magnesium oxide particles, according to an embodiment of the present invention.

On the other hand, a CL spectrum of VIC-containing magnesium oxide particles is different from that of a magnesium oxide layer which has been described above. FIG. 2 is a CL spectrum of high-purity mono-crystalline magnesium oxide particles measured at 6K. The CL spectrum of FIG. 2 has three peaks in which a peak at about 3 eV is the result of emission related to F center, a peak at about 5.3 eV is the result of emission related to VIC, and a peak at 7.6 eV is the result of emission related to free excitons (FE). Therefore, it can be identified that mono-crystalline magnesium oxide particles have VIC.

Figure 3:
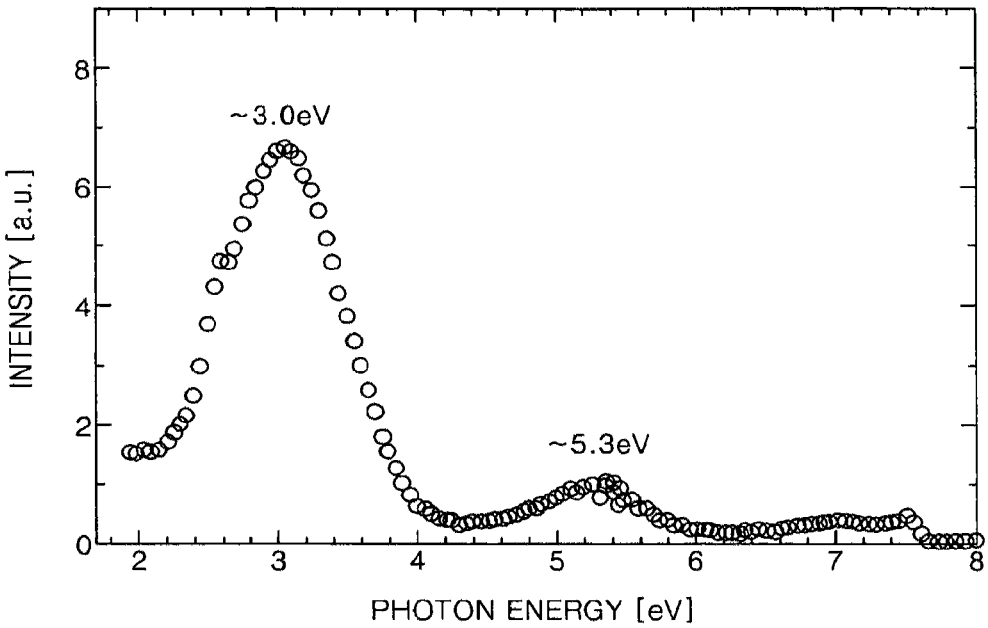
FIG. 3 illustrates a CL emission spectrum of polycrystalline magnesium oxide particles, according to an embodiment of the present invention.

FIG. 3 illustrates a CL spectrum of a polycrystalline magnesium oxide pellet which has further Ca, Al, Si, and Zr which can be added in the manufacturing process at room temperature. In the CL spectrum of FIG. 3, a peak related to the F center appears at about 3.0 eV and a peak related to VIC appears at about 5.3 eV.

Figure 4:
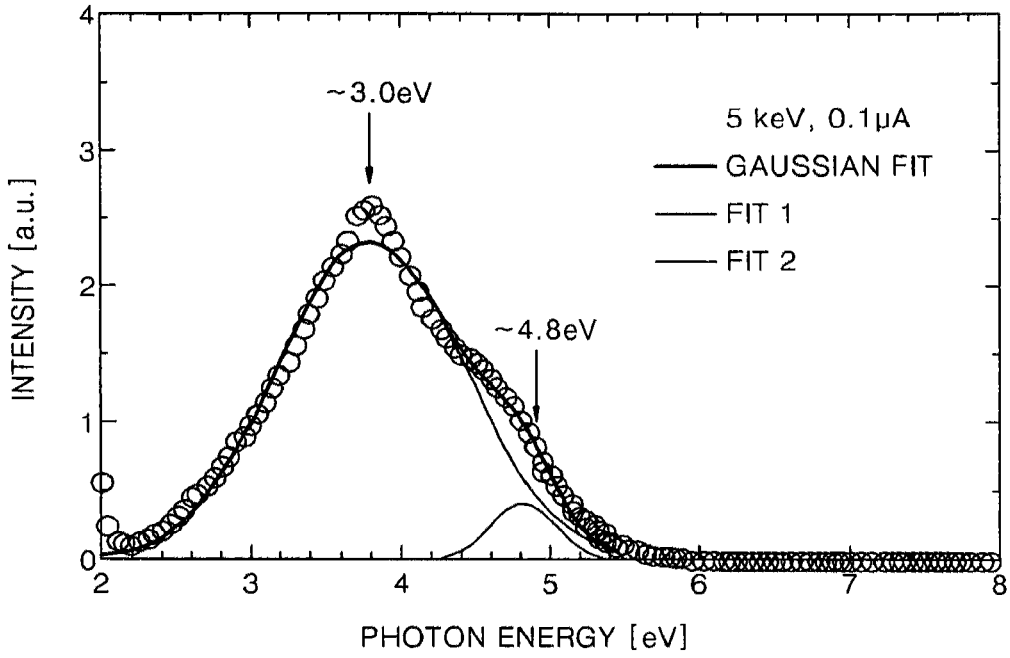
FIG. 4 illustrates a CL emission spectrum of Sc-containing polycrystalline magnesium oxide particles.

FIG. 4 is a CL spectrum of Sc-containing (Sc exists in an amount of about 300 mass ppm) high purity (Ca<30 mass ppm, Al<30 mass ppm, Si<30 mass ppm, and Zr<30 mass ppm) magnesium oxide particles at room temperature. In the CL spectrum of FIG. 4, the peak of VIC emission appears between 3.8 eV and 4.8 eV, but the peak of emission related to the F center at around 3.0 eV is overlapped by a strong VIC emission peak and thus is not shown. That is, the peak of VIC can be located at different positions according to an element additionally contained in addition to the magnesium oxide.

As shown in FIGS. 2, 3 and 4, unlike the magnesium oxide layer, magnesium oxide particles have VIC, which can be identified by analyzing peaks of a CL spectrum. The emission range of peak related to VIC may vary according to additional elements contained in magnesium oxide particles, for example, a rare-earth element, Al, Ca, or Si, other than magnesium oxide. Therefore, the CL emission spectrum of the magnesium oxide particles according to the current embodiment of the present invention has a peak from VIC emission between about 3.1 eV and about 6 eV. For example, the CL emission spectrum of the magnesium oxide particles according to the other current embodiment of the present invention may have a peak from VIC emission between about 3.1 eV and about 4.2 eV, preferably between about 3.35 eV and about 3.87 eV.

In VIC-containing magnesium oxide particles described above, the vacancy of VIC generates an acceptor level and a hole is formed, and the impurity of VIC generates a donor level and an electron is formed. Therefore, through the transition between the acceptor level and the donor level, the magnesium oxide particles can have many electrons. Therefore, when a PDP is operated, more secondary electrons can be emitted, unlike a protecting layer formed of a magnesium oxide layer (without VIC) alone. Such secondary electron emission mechanism can be understood, for example, according to the Auger neutralization principle although not limited one principle.

Figure 5:
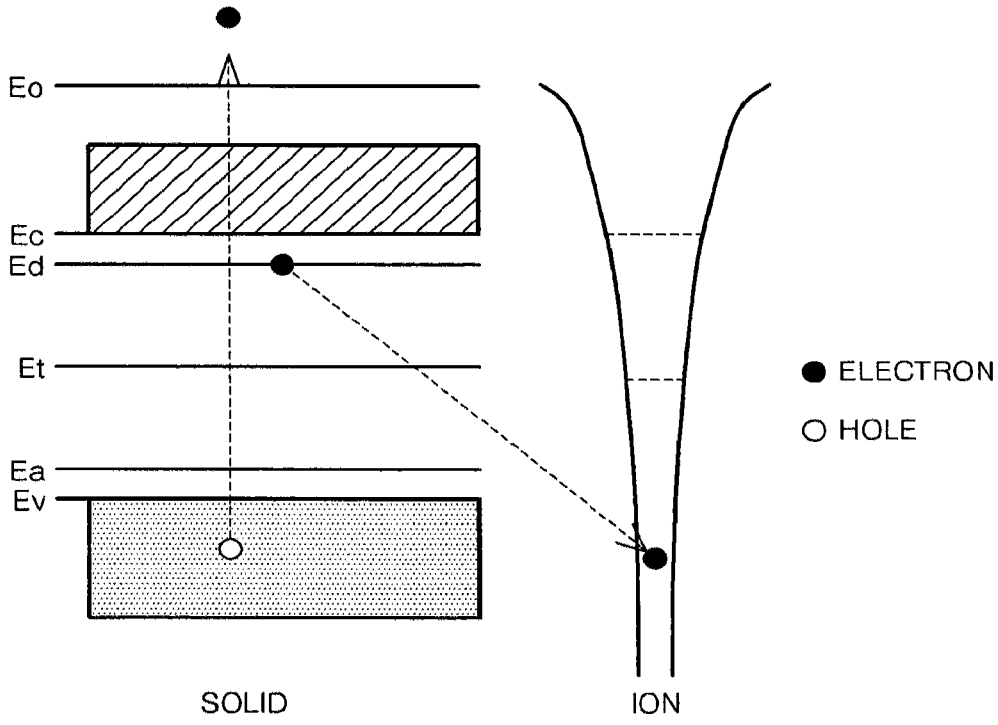
FIG. 5 is a schematic diagram illustrating emission of electrons from a solid by a gaseous ion according to an auger neutralization principle.

FIG. 5 is a schematic diagram illustrating emission of electrons from a solid by a gaseous ion according to the Auger neutralization principle although not limited to one principle. Referring to FIG. 5, when a gaseous ion collides with a solid, an electron moves from the solid to the gaseous ion to form a neutral gas and another electron of the solid moves into a vacuum to form a hole. In this regard, the energy generated when an electron is emitted from a solid when it collides with a gaseous ion can be expressed using Equation 1.

$$E_k = E_I - 2E_g + \chi \qquad \text{Equation 1}$$

where $E_k$ is energy generated when an electron is emitted from a solid when it collides with a gaseous ion; $E_I$ is ionization energy of the gas; $E_g$ is energy of the band gap of the solid; and $\chi$ is an electron affinity of the solid.

The Auger neutralization principle and Equation 1 can be applied to a protecting layer for a PDP and a discharge gas. When a voltage is applied to a pixel for a PDP, a seed electron generated by a cosmic ray or an ultraviolet ray collides with a discharge gas to generate a discharge gaseous ion and the discharge gaseous ion collides with the protecting layer to emit a secondary electron.

Table 1 below shows the resonance emission wavelength and dissociation voltage of an inert gas acting as a discharge gas, that is, ionization energy of the discharge gas. When a protecting layer is formed of magnesium oxide, the band gap energy of the solid, that is, $E_g$ of Equation 1 is 7.7 eV that is the band gap energy of magnesium oxide, and the electron affinity $\chi$ is 0.5 that is the electron affinity of magnesium oxide.

In the meantime, Xe gas that can generate a vacuum ultraviolet ray having the longest possible wavelength is suitable for improving light conversion efficiency of a phosphor for a PDP. However, Xe has a dissociation voltage, that is, ionization energy $E_I$ of 12.13 eV, and thus energy generated when an electron is emitted from a protecting layer formed of magnesium oxide, that is, $E_k$ of Equation 1, is less than 0. Therefore, a very high discharge voltage is required. Accordingly, there is a need to use a gas having a high dissociation voltage $E_I$ to reduce the discharge voltage. According to Equation 1, with respect to the magnesium oxide protecting layer, when He is used, $E_k$ is 8.19 eV; and when Ne is used, $E_k$ is 5.17 eV. Therefore, it can be shown that He or Ne is suitable for low discharge initiation voltage. However, when He gas is used for PDP discharging, the protecting layer can be damaged by plasma etching due to high mobility of He.

TABLE 1

| | Resonance Level Excitation | | | Semi Stable Level Excitation | | Dissociation |
|---|---|---|---|---|---|---|
| Gas | Voltage (eV) | Wavelength (nm) | Lifetime (ns) | Voltage (eV) | Lifetime (ns) | Voltage (eV) |
| He | 21.2 | 58.4 | 0.555 | 19.8 | 7.9 | 24.59 |
| Ne | 16.54 | 74.4 | 20.7 | 16.62 | 20 | 21.57 |
| Ar | 11.61 | 107 | 10.2 | 11.53 | 60 | 15.76 |
| Kr | 9.98 | 124 | 4.38 | 9.82 | 85 | 14.0 |
| Xe | 8.45 | 147 | 3.79 | 8.28 | 150 | 12.13 |

Therefore, it is more desirable to obtain easy emission of secondary electrons from the protecting layer, rather than modification of a discharge gas. As described in this specification, when magnesium oxide-containing particles having VIC exist at the surface of a magnesium oxide-containing layer, secondary electrons can be efficiently emitted since magnesium oxide-containing particles, unlike a magnesium oxide-containing layer, have many electrons, and thus, the discharge voltage can be reduced. Therefore, a PDP using such a protecting layer can have a low operating voltage and low power consumption.

Magnesium oxide-containing particles can be uniformly or non-uniformly attached to the surface of the magnesium oxide-containing layer.

Figure 6:
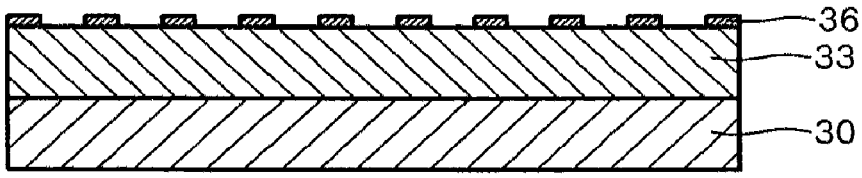
FIGS. 6 and 7 illustrate a protecting layer for a PDP, according to an embodiment of the present invention.

FIG. 6 illustrates a protecting layer for a PDP, according to an embodiment of the present invention, in which magnesium oxide-containing particles are uniformly attached to the surface of a magnesium oxide-containing layer. Referring to FIG. 6, the protecting layer according to the current embodiment of the present invention includes a magnesium oxide-containing layer 33 formed on a substrate 30, and a magnesium oxide particles-containing layer 36 formed on the magnesium oxide-containing layer 33. The substrate 30 has an area on which the magnesium oxide-containing layer 33 is to be formed. For example, the substrate 30 can be a dielectric layer of a PDP, but is not limited thereto. The magnesium oxide particles-containing layer 36 can have, for example, a stripe pattern or a dot pattern, such that magnesium oxide particles are regularly attached to the surface of the magnesium oxide-containing layer 33. Referring to FIG. 6, magnesium oxide particles can be uniformly attached to a surface of the magnesium oxide-containing layer 33 using, for example, a known photolithographic method.

Figure 7:
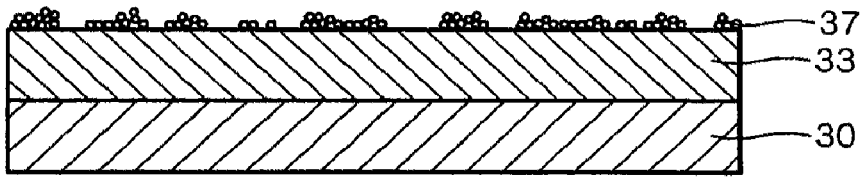

On the other hand, FIG. 7 illustrates a protecting layer for a PDP, according to an embodiment of the present invention, in which magnesium oxide-containing particles 37 are non-uniformly attached to the surface of a magnesium oxide-containing layer 33. Referring to FIG. 7, the protecting layer according to the current embodiment of the present invention includes a magnesium oxide-containing layer 33 formed on a substrate 30, and magnesium oxide particles 37 formed on the surface of the magnesium oxide-containing layer 33. As illustrated in FIG. 7, the magnesium oxide particles 37 can be non-uniformly attached to the surface of the magnesium oxide-containing layer 33 by, for example, spraying a mixture of magnesium oxide particles and a solvent onto a surface of the magnesium oxide-containing layer 33 and then heat-treating the resultant structure.

A magnesium oxide-containing layer according to the present invention, that is, a layer represented by reference numeral 33 in FIGS. 6 and 7, can be any known protecting layer which is formed using mono-crystalline magnesium oxide pellets or polycrystalline magnesium oxide pellets.

The magnesium oxide-containing layer can include, in addition to magnesium oxide, a rare-earth element. The rare-earth element can be Sc (scandium), Y (yttrium), La (lanthan), Ce (cerium), Pr (praseodymium), Nd (neodymium), Pm (promethium), Sm (samarium), Eu (europium), Gd (gadolinium), Tb (terbium), Dy (dysprosium), Ho (holmium), Er (erbium), Tm (thulium), Yb (ytterbium), or Lu (lutetium). Furthermore, the magnesium oxide-containing layer can include one or more of the above elements. For example, the magnesium oxide-containing layer can further include Sc.

The amount of the rare-earth element may be in the range of $5.0\times10^{-5}$ parts by weight to $6.0\times10^{-4}$ parts by weight, preferably, $5.0\times10^{-5}$ parts by weight to $5.0\times10^{-4}$ parts by weight, and more preferably, $1.5\times10^{-4}$ parts by weight to $4.0\times10^{-4}$ parts by weight, based on 1 part by weight of magnesium oxide in the magnesium oxide-containing layer. When the amount of the rare-earth element is outside the above range, a reduction in discharge delay time and in temperature dependency of the discharge delay time may be unsatisfactory.

The magnesium oxide-containing layer can further include one or more elements selected from Ca, Si and Al.

When the magnesium oxide-containing layer further includes Al, the discharge delay time at low temperature can be more reduced. The amount of Al may be in the range of $5.0\times10^{-5}$ parts by weight to $4.0\times10^{-4}$ parts by weight, specifically $6.0\times10^{-5}$ parts by weight to $3.0\times10^{-4}$ parts by weight, based on 1 part by weight of magnesium oxide of the layer.

When the magnesium oxide-containing layer further includes Ca, a discharge delay time can be more independent with respect to temperature. That is, the discharge delay time may not substantially vary according to temperature. The amount of Ca may be in the range of $5.0\times10^{-5}$ parts by weight to $4.0\times10^{-4}$ parts by weight, specifically, $6.0\times10^{-5}$ parts by weight to $3.0\times10^{-4}$ parts by weight, based on 1 part by weight of magnesium oxide of the layer.

When the magnesium oxide-containing layer further includes Si, the discharge delay time at low temperature can be more reduced. The amount of Si may be in the range of $5.0\times10^{-5}$ parts by weight to $4.0\times10^{-4}$ parts by weight, specifically, $6.0\times10^{-5}$ parts by weight to $3.0\times10^{-4}$ parts by weight, based on 1 part by weight of magnesium oxide of the layer. In particular, when the amount of Si is outside this range, a glass phase can be formed in the layer.

The magnesium oxide-containing layer can further include, in addition to the rare-earth element, Al, Ca, and Si, one or more elements selected from the group consisting of Mn, Na, K, Cr, Fe, Zn, B, Ni and Zr in a small amount as determined to be as an impurity.

Magnesium oxide-containing particles which are attached to the surface of the magnesium oxide-containing layer can include, in addition to magnesium oxide, a rare-earth element. The rare-earth element can be Sc (scandium), Y (yttrium), La (lanthan), Ce (cerium), Pr (praseodymium), Nd (neodymium), Pm (promethium), Sm (samarium), Eu (europium), Gd (gadolinium), Tb (terbium), Dy (dysprosium), Ho (holmium), Er (erbium), Tm (thulium), Yb (ytterbium), or Lu (lutetium). The magnesium oxide-containing particles can include one or more elements selected from the above elements. For example, magnesium oxide-containing particles can contain Sc.

The amount of the rare-earth element may be in the range of $5.0\times10^{-5}$ parts by weight to $6.0\times10^{-4}$ parts by weight, preferably, $5.0\times10^{-5}$ parts by weight to $5.0\times10^{-4}$ parts by weight, and more preferably, $1.5\times10^{-4}$ parts by weight to $4.0\times10^{-4}$ parts by weight, based on 1 part by weight of magnesium oxide of the magnesium oxide-containing particles. When the amount of the rare-earth element is outside this range, a reduction in discharge delay time and in temperature dependency of the discharge delay time may be unsatisfactory.

The magnesium oxide-containing particles may further include one or more elements selected from Ca, Si and Al.

When the magnesium oxide-containing particles further include Al, the discharge delay time at low temperature can be more reduced. The amount of Al may be in the range of $5.0\times10^{-5}$ parts by weight to $4.0\times10^{-4}$ parts by weight, specifically $6.0\times10^{-5}$ parts by weight to $3.0\times10^{-4}$ parts by weight, based on 1 part by weight of magnesium oxide of magnesium oxide-containing particles.

When the magnesium oxide-containing particles further include Ca, the discharge delay time can be more independent upon temperature. That is, the discharge delay time may not substantially vary according to temperature. The amount of Ca may be in the range of $5.0\times10^{-5}$ parts by weight to $4.0\times10^{-4}$ parts by weight, specifically, $6.0\times10^{-5}$ parts by weight to $3.0\times10^{-4}$ parts by weight, based on 1 part by weight of magnesium oxide of the magnesium oxide-containing particles.

When the magnesium oxide-containing particles further include Si, the discharge delay time at low temperature can be more reduced. The amount of Si may be in the range of $5.0\times10^{-5}$ parts by weight to $4.0\times10^{-4}$ parts by weight, specifically, $6.0\times10^{-5}$ parts by weight to $3.0\times10^{-4}$ parts by weight, based on 1 part by weight of magnesium oxide of the magnesium oxide-containing particles. In particular, when the amount of Si is outside this range, a glass phase can be formed in the magnesium oxide-containing particles.

The magnesium oxide-containing particles can further include, in addition to the rare-earth element and one or more elements selected from Al, Ca, and Si, one or more elements selected from the group consisting of Mn, Na, K, Cr, Fe, Zn, B, Ni and Zr in a small amount as determined to be as an impurity.

The magnesium oxide-containing particles attached to the magnesium oxide-containing layer may have an average diameter of 50 nm to 2 μm, specifically 100 nm to 1 μm. When the average diameter of the magnesium oxide-containing particles is less than 50 nm, a secondary electron emission effect may be too small. On the other hand, when the average diameter of the magnesium oxide-containing particles is greater than 2 μm, magnesium oxide-containing particles may be agglomerated together, which can cause distribution of a process.

A method of forming a protecting layer for a PDP according to an embodiment of the present invention includes forming a magnesium oxide-containing layer on a substrate, preparing magnesium oxide-containing particles, and attaching the magnesium oxide-containing particles to the surface of the magnesium oxide-containing layer.

First, a magnesium oxide-containing layer is formed on a substrate. The magnesium oxide-containing layer is to be formed on various kinds of a substrate according to the structure for a PDP. For example, the substrate can be a dielectric layer of a PDP. The magnesium oxide-containing layer can be formed using a conventional thin layer forming method, such as an E-beam evaporation method, a plasma evaporation method, a sputtering method, or a chemical vapor deposition method. The magnesium oxide-containing layer may be formed using mono-crystalline magnesium oxide pellets or polycrystalline magnesium oxide pellets. The mono-crystalline magnesium oxide pellets or polycrystalline magnesium oxide pellets can include a rare-earth element, Ca, Si, or Al.

Therefore, the magnesium oxide-containing layer can include, in addition to magnesium oxide, a rare-earth element, Ca, Si, or Al.

Meanwhile, magnesium oxide-containing particles to be attached to the magnesium oxide-containing layer are prepared. Magnesium oxide-containing particles to be attached to the magnesium oxide-containing layer can be prepared using any known precipitation method, a chemical vapor oxidation (CVO) method, or a pellet milling method.

Figure 8:
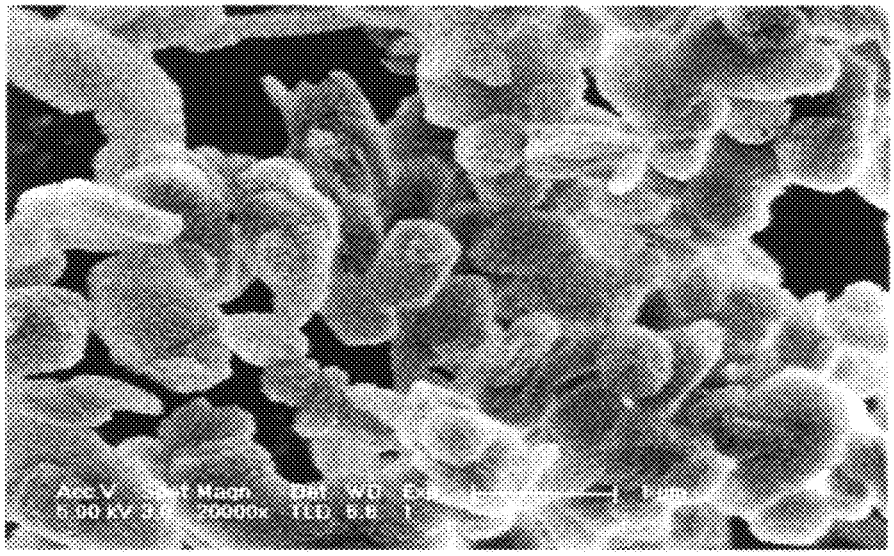
FIG. 8 is a scanning electron microscopic (SEM) image of an example of magnesium oxide particles prepared using a precipitation method.

FIG. 8 is a scanning electron microscopic (SEM) image of magnesium oxide particles formed using a precipitation method. The precipitation method will now be described in detail. $NH_4OH$ is added to a solution having a salt of Mg, such as $MgCl_2$, dissolved therein to prepare a supersaturated solution. A crystal grain is generated and grows in the supersaturated solution and $Mg(OH)_2$ is precipitated. The precipitated product is heated at 1000° C. to remove water and thus magnesium oxide particles can be obtained.

Figure 9:
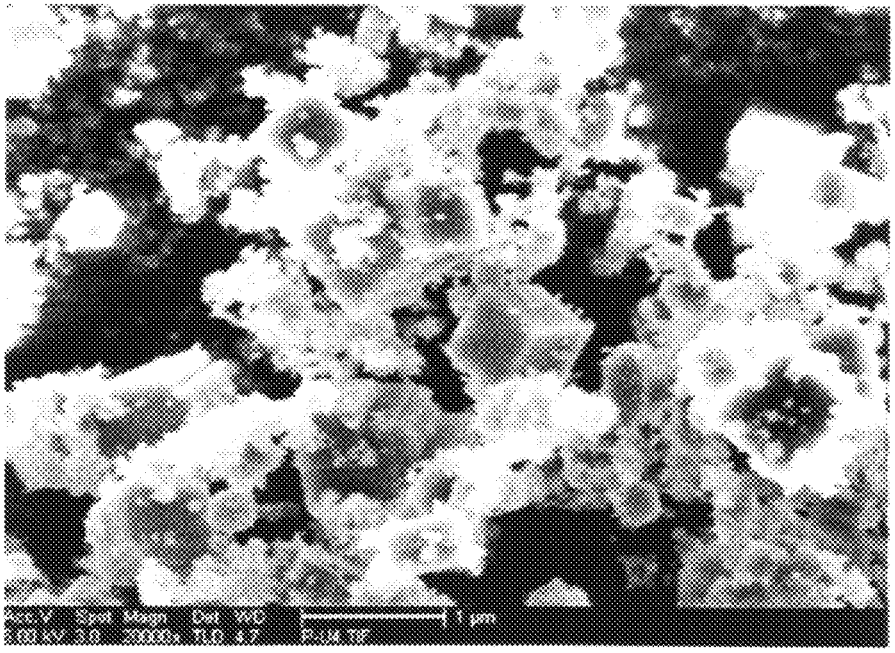
FIG. 9 is a SEM image of an example of magnesium oxide particles prepared using a chemical vapor oxidation (CVO) method.

FIG. 9 is a scanning electron microscopic (SEM) image of magnesium oxide particles formed using a CVO method. The CVO method will now be described in detail. Particles of Mg are heated to obtain a vapor of Mg and the obtained magnesium vapor is reacted with high-temperature oxygen to produce magnesium oxide particles having a cubic shape. The pellet milling method can be any milling method by which magnesium oxide pellets are milled into particles having such average diameter as described above.

Then, magnesium oxide-containing particles are attached to the magnesium oxide-containing layer. Specifically, the magnesium oxide-containing particles can be uniformly attached to the magnesium oxide-containing layer as illustrated in FIG. 6, or non-uniformly attached to magnesium oxide-containing layer as illustrated in FIG. 7.

A conventional photolithography method can be used to uniformly attach the magnesium oxide particles to the magnesium oxide-containing layer as illustrated in FIG. 6. First, a photoresist layer is formed on the magnesium oxide-containing layer, and then magnesium oxide particles can be introduced using a conventional thick-layer forming method, such as a screen printing method, a sol-gel coating method, a spin coating method, a dipping method, or a spraying method and the formed photoresist layer is removed. As a result, a magnesium oxide particles-containing layer having a predetermined pattern, such as a stripe pattern or a dot pattern, can be obtained.

Meanwhile, in order to non-uniformly attach the magnesium oxide-containing particles to the magnesium oxide-containing layer as illustrated in FIG. 7, a mixture of magnesium oxide particles and a solvent are prepared and then the mixture is applied to the surface of the magnesium oxide-containing layer and heat-treated. In this regard, the mixture can be applied to the surface of the magnesium oxide-containing layer using, for example, a spraying method.

The solvent of such mixture can be ethanol or isopropanol, but is not limited thereto. The heat treatment temperature may vary according to the boiling point and evaporating properties of the solvent used and the kind of magnesium oxide-containing layer. For example, the heat treatment temperature may be in the range of about 80° C. to about 350° C. When the heat treatment temperature is less than 80° C., the solvent may be inefficiently evaporated. On the other hand, when the heat treatment temperature is greater than 350° C., the magnesium oxide-containing layer can be damaged.

Figure 10:
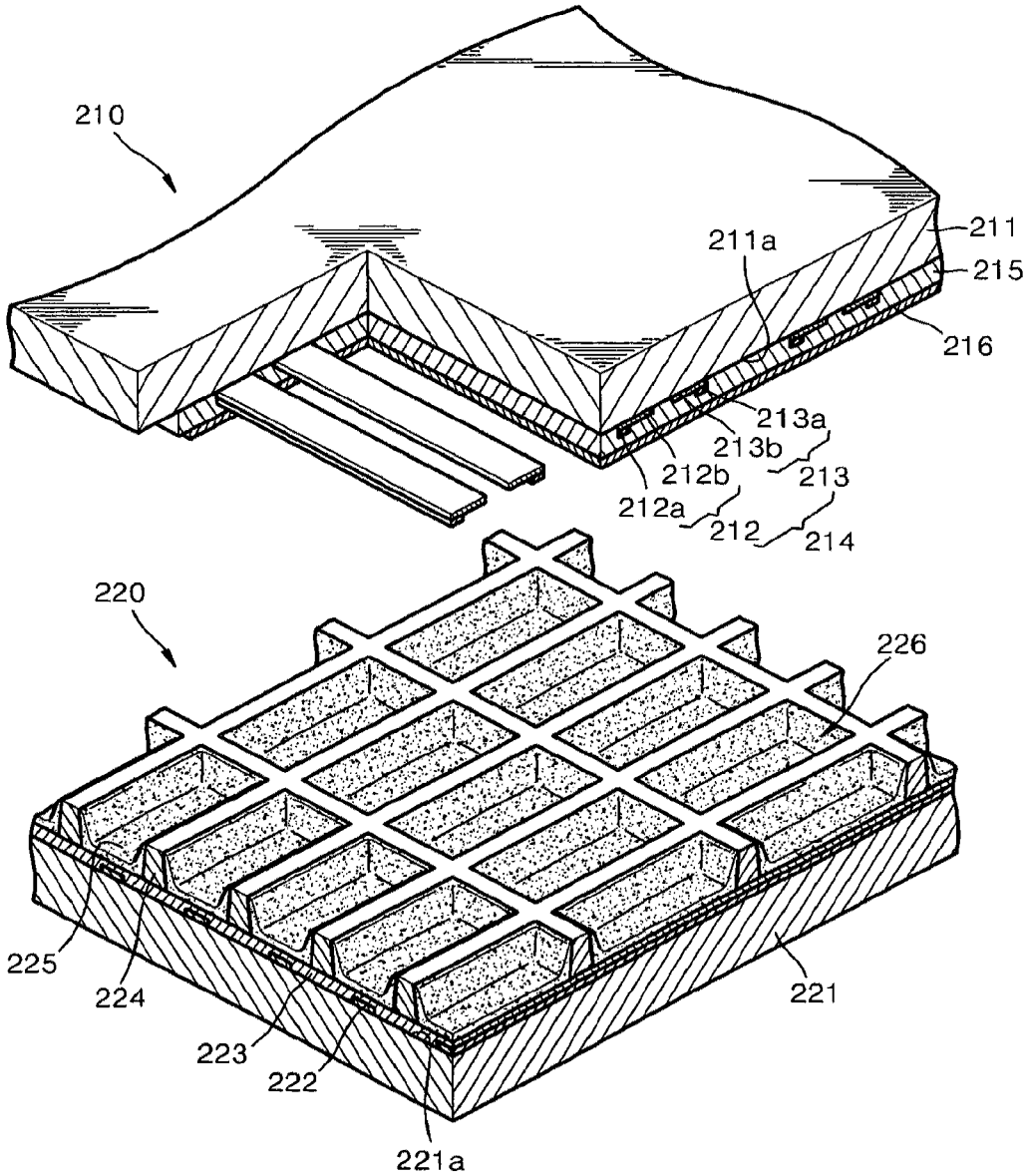
FIG. 10 is an exploded perspective view of an example of a PDP including a protecting layer according to an embodiment of the present invention.

The protecting layer having a magnesium oxide-containing layer having a surface to which magnesium oxide-containing particles are attached according to the present invention can be used in a gas discharge display device, specifically, a PDP. FIG. 10 is an exploded perspective view of an example of a PDP including a protecting layer according to an embodiment of the present invention.

Referring to FIG. 10, the PDP according to the current embodiment of the present invention includes a first panel 210 including: a first substrate 211; sustain electrodes 214 formed on a bottom (or inner) surface 211*a* of the first substrate 211, wherein each sustain electrode 214 includes a Y electrode 212 and a X electrode 213; a first dielectric layer 215 covering the sustain electrodes 214; and a protecting layer 216, formed according to an embodiment of the present invention, covering the first dielectric layer 215. Therefore, the PDP of the current embodiment of the present invention can have excellent discharging properties, and thus is suitable for an increase in the content of Xe, and a single scan method can be used. A detailed description of the protective layer 216 is given above. The Y electrode 212 and the X electrode 213 respectively include transparent electrodes 212*b* and 213*b* which are formed of, for example, ITO, and bus electrodes 212*a* and 213*a* which are formed of a metal having good conductivity. The protecting layer 216 comprises a magnesium oxide-containing layer having a surface to which magnesium oxide-containing particles are attached according to the present invention, which has been described in detail above.

The PDP according to the current embodiment of the present invention further includes a second panel 220 including a second substrate 221, address electrodes 222 formed on a top (or inner) surface 221*a* of the second substrate 221 to cross the sustain electrode pairs 214, a second dielectric layer 223 covering the address electrode 222, a plurality of barrier ribs 224 which are formed on the second dielectric layer 223 and define discharge cells 226, and a phosphor layer 225 disposed inside the discharge cells 226. The discharge cells 226 can be filled with a gaseous mixture of Ne and at least one type of gas selected from Xe, $N_2$ and $Kr_2$, or with a gaseous mixture of Ne and at least two types of gas selected from Xe, He, $N_2$, and Kr.

The protecting layer according to the present invention can be used in a two-component gaseous mixture of Ne and Xe as the discharge gas, in which an amount of Xe is increased in order to improve brightness. A protecting layer according to the present invention can provide a high sputtering resistance and can prevent a decrease in the lifetime for a PDP in a three-component gaseous mixture of Ne, Xe, and He as the discharge gas. Therefore, a decrease in the lifetime for a PDP can be prevented. The present invention provides a protective layer capable of reducing an increase in discharge voltage due to an increase in Xe content and satisfying a discharge delay time required for a single scan method.

The present invention will be described in further detail with reference to the following examples. These examples are for illustrative purposes only and are not intended to limit the scope of the present invention.

EXAMPLE 1

A discharge cell substrate was prepared such that an ϕ8 mm Ag electrode, a connection pad, and a 30 μm-thick PbO-containing $SiO_2$ dielectric layer were formed on a 2.8 mm-thick glass panel for a PDP, in which the 30 μm-thick PbO-containing $SiO_2$ dielectric layer was formed on the ϕ8 mm Ag electrode.

Then, a magnesium oxide-containing layer was formed on the PbO-containing $SiO_2$ dielectric layer to a thickness of about 0.7 μm using an e-beam evaporation method. In the e-beam evaporation method, the temperature of the discharge cell substrate was 250° C., and the pressure was adjusted to $6\times10^{-4}$ torr using oxygen and argon gases through a gas flow controller. The magnesium oxide-containing layer was formed from a polycrystalline magnesium oxide.

Meanwhile, magnesium oxide-containing particles having an average particle diameter of 500 nm and containing Sc in an amount of $4.0\times10^{-4}$ parts by weight based on 1 part by weight of magnesium oxide of the magnesium oxide-containing particles were prepared. Such magnesium oxide-containing particles having Sc were obtained in such a manner that a Sc nitrate solution and $MgCl_2$ aqueous solution were mixed in ethanol and $NH_4OH$ was added thereto to precipitate a $Mg(OH)_2$ having Sc, the precipitated product was collected and heat-treated at 1000° C. to obtain magnesium oxide-containing particles having Sc, and then the obtained magnesium oxide-containing particles having Sc were milled using a plasma milling method to obtain magnesium oxide particles having an average particle diameter of 500 nm and containing Sc in an amount of $4.0\times10^{-4}$ parts by weight based on 1 part by weight of the magnesium oxide of the magnesium oxide-containing particles having Sc (hereinafter, referred to as "Sc-containing magnesium oxide particles").

1 g of the Sc-containing magnesium oxide particles was added to 15 ml of ethanol, and the obtained mixture was stirred. The stirred product was sprayed onto the magnesium oxide-containing layer. Then, the obtained structure was heat treated at 150° C. so as to attach the Sc-containing magnesium oxide particles onto the magnesium oxide-containing layer.

A 120 μm-thick quartz sieve was interposed between the two discharge cell substrates to form a facing discharge cell. The facing discharge cell was placed in a high-vacuum chamber and the high-vacuum chamber was sufficiently evacuated and purged with Ar gas to remove moisture therein. Then, a gaseous mixture of Ne and Xe in a mixture ratio of 9:1 as a discharge gas was added to the high-pressure chamber. As a result, a discharge measurement cell (Sample 1) was prepared.

COMPARATIVE EXAMPLE A

A discharge cell (Sample A) for evaluation was prepared in the same manner as in Example 1, except that the Sc-containing magnesium oxide particles were not attached to the magnesium oxide-containing layer.

EXAMPLE 2

A bus electrode comprising copper was formed on a 2.8 mm-thick glass substrate using a photolithography method. PbO glass was coated on the bus electrode to form a front dielectric layer having a thickness of 20 μm.

Then, a magnesium oxide-containing layer was formed to a thickness of about 0.7 μm on the PbO dielectric layer using an e-beam evaporation method. In the e-beam evaporation method, the temperature of the substrate was 250° C., and the pressure was adjusted to $6\times10^{-4}$ torr using oxygen and argon gases through a gas flow controller. The magnesium oxide-containing layer was formed from a polycrystalline magnesium oxide.

Meanwhile, magnesium oxide-containing particles having an average particle diameter of 500 nm and containing Sc in an amount of $4.0\times10^{-4}$ parts by weight based on 1 part by weight of magnesium oxide of the magnesium oxide-containing particles were prepared. Such Sc-containing magnesium oxide particles was obtained in such a manner that a Sc nitrate solution and $MgCl_2$ aqueous solution were mixed in ethanol and $NH_4OH$ was added thereto to precipitate $Mg(OH)_2$ having Sc, the precipitated product was collected and heat-treated at 1000° C. to obtain Sc-containing magnesium oxide-containing particles, and then the obtained Sc-containing magnesium oxide-containing particles were milled using a plasma milling method to obtain magnesium oxide-containing particles having an average particle diameter of 500 nm and containing Sc in an amount of $4.0\times10^{-4}$ parts by weight based on 1 part by weight of magnesium oxide of the Sc-containing magnesium oxide-containing particles.

1 g of the Sc-containing magnesium oxide particles was added to 15 ml of ethanol and the mixture was stirred. The stirred product was sprayed onto the magnesium oxide-containing layer. Then, the obtained structure was heat treated at 150° C. so as to attach the Sc-containing magnesium oxide particles onto the magnesium oxide-containing layer.

The substrate prepared as described above and a rear substrate were disposed to face each other with a distance of 120 μm, thereby forming a discharge cell. Then, the discharge cell was filled with a gaseous mixture of Ne and Xe in a mixture ratio of 9:1 acting as a discharge gas. As a result, 42-inch SD V4 PDP (Sample 2) was produced.

COMPARATIVE EXAMPLE B

A PDP (Sample B) was prepared in the same manner as in Example 2, except that the Sc-containing magnesium oxide particles were not attached to the magnesium oxide-containing layer.

Measurement 1: Discharge Initiation Voltages of Samples 1 and A

The discharge initiation voltages of Samples 1 and A were measured. The results are shown in FIG. 11.

The discharge initiation voltage was measured using a Tektronix oscilloscope, a trek amplifier, an NF function generator, a high-vacuum chamber, a peltier device, a I-V power source, and a LCR meter. First, Sample A was connected to the trek amplifier and the NF function generator, and then a 2 kHz sinuous wave was applied thereto to measure a discharge initiation voltage. Such process was also performed on Sample 1.

Figure 11:
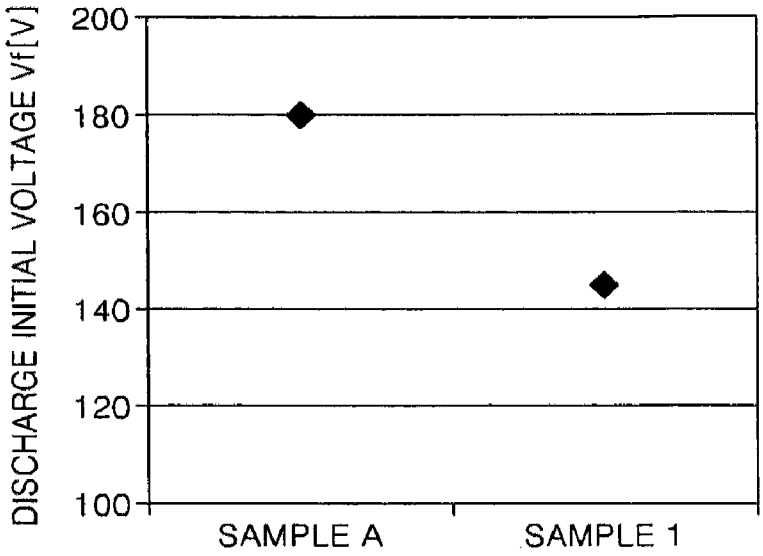
FIG. 11 is a graph of an discharge initiation voltage of a protecting layer according to an embodiment of the present invention and a conventional protecting layer.

The results are shown in FIG. 11. Referring to FIG. 11, it can be seen that Sample 1 according to the present invention has lower discharge initiation voltage than Sample A.

Measurement 2: Secondary Electron Emission Coefficients of Samples 1 and A

Secondary electron emission coefficients of Samples 1 and A were measured. The results are shown in FIG. 12.

The secondary electron emission coefficients were measured by irradiating an accelerated focused ion beam (FIB) onto Samples 1 and A. Specifically, the protecting layer of Sample A was collided with a $Ne^+$ ion, and electrons emitted from Sample A were collected by applying a positive voltage (+15V) to a Faraday cup. Ions entering Sample A were collected using a Faraday cup and the amount of the collected ions was mathematically computed to obtain a secondary electron emission coefficient of Sample A. Such process was also performed on Sample 1.

Figure 12:
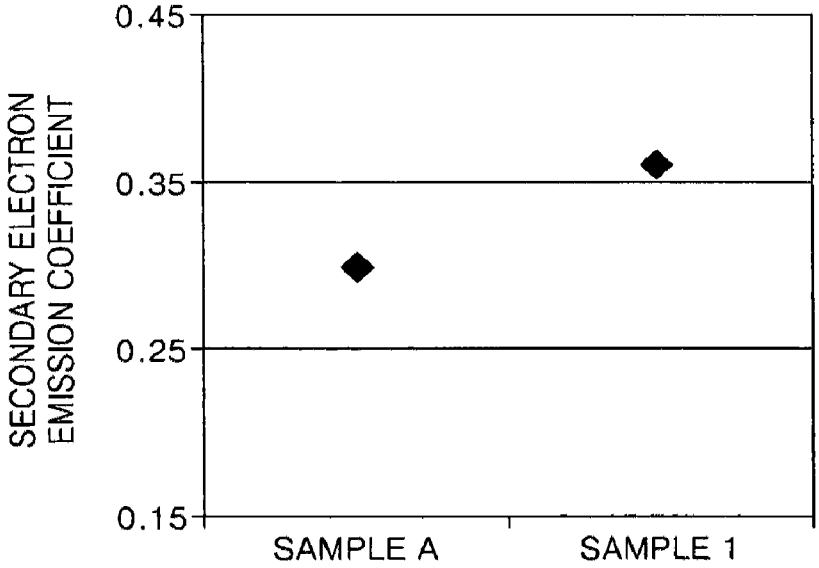
FIG. 12 is a graph of secondary electron emission coefficients of a protecting layer according to an embodiment of the present invention and a conventional protecting layer.

Referring to FIG. 12, it can be seen that Sample 1 according to the present invention has a higher secondary electron emission coefficient than Sample A.

Measurement 3: Discharge Delay Time of Samples 2 and B

Figure 13:
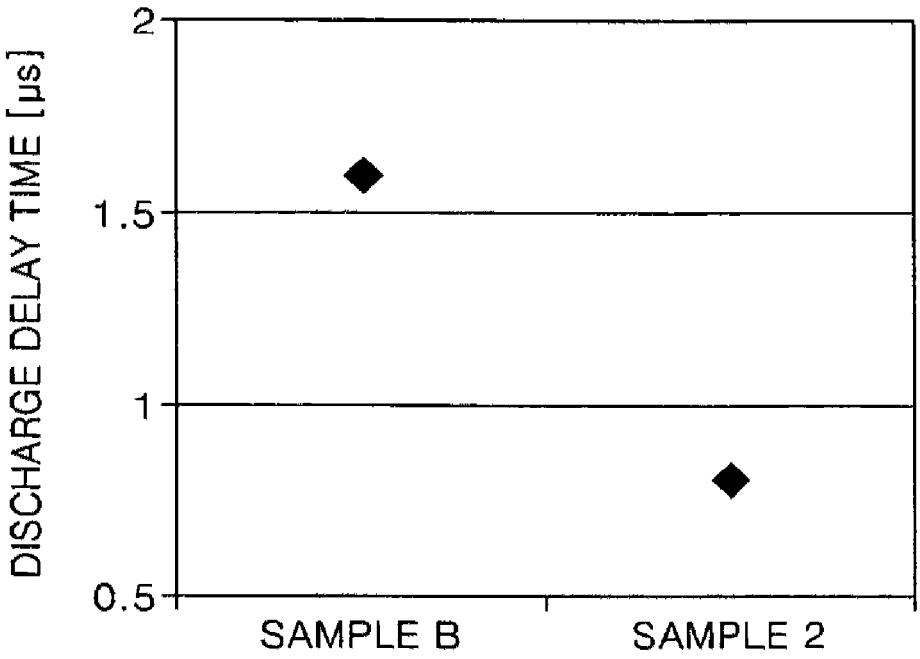
FIG. 13 is a graph of a discharge delay time of a protecting layer according to an embodiment of the present invention and a conventional protecting layer.

A discharge delay time (unit: ns) of Samples 2 and B with respect to temperature was measured. The results are shown in FIG. 13. Referring to FIG. 13, it can be seen that Sample 2 that is a PDP manufactured according to the principles of the present invention has a shorter discharge delay time than Sample B.

Therefore, Sample 2 that is a PDP including the protecting layer of the present invention has a short discharge delay time and thus, is suitable for increase in Xe content and single scan.

A protecting layer according to the present invention includes a magnesium oxide-containing layer having a surface to which magnesium oxide-containing particles having Mg vacancy impurity center (VIC) are attached, and specifically, magnesium oxide particles form the surface of the protecting layer. Therefore, the protecting layer of the present invention can emit more secondary electrons and can be resistant to the plasma ion, and a PDP including the protecting layer has low discharge voltage and low power consumption.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A protecting layer for a PDP, comprising:

a magnesium oxide-containing layer, the magnesium oxide-containing layer including an element selected from the group consisting of Al, Ca, and Si; and magnesium oxide-containing particles formed on a surface of the magnesium oxide-containing layer, the magnesium oxide-containing particles having a magnesium vacancy-impurity center (VIC), the magnesium oxide containing particles comprising a rare earth element as the impurity forming the magnesium VIC and inducing a transition between a state formed by the impurity of the magnesium VIC and another state formed by a magnesium vacancy, the magnesium oxide-containing particles being formed in a regular pattern.

2. The protecting layer of claim 1, wherein a cathodoluminescence (CL) emission spectrum of the magnesium oxide-containing particles has a peak from VIC in the range of 3.1 eV to 6 eV.

3. The protecting layer of claim 1, wherein a cathodoluminescence (CL) emission spectrum of the magnesium oxide containing particles has a peak from VIC in the range of 3.1 eV to 4.2 eV.

4. The protecting layer of claim 1, wherein a cathodoluminescence (CL) emission spectrum of the magnesium oxide containing particles has a peak from VIC in the range of 3.35 eV to 3.87 eV.

5. The protecting layer of claim 1, wherein the magnesium oxide-containing layer further comprises a rare-earth element.

6. The protecting layer of claim 1, wherein the magnesium oxide containing particles further comprise scandium (Sc).

7. The protecting layer of claim 1, wherein the magnesium oxide-containing particles further comprise an element selected from the group consisting of Al, Ca, and Si.

8. The protecting layer of claim 1, wherein the magnesium oxide-containing particles have an average particle diameter of 50 nm to 2 μm.

9. A method of forming a protecting layer for a PDP, the method comprising:

forming a magnesium oxide-containing layer on a substrate, the magnesium oxide-containing layer including an element selected from the group consisting of Al, Ca, and Si;

preparing magnesium oxide-containing particles; and attaching the magnesium oxide-containing particles to a surface of the magnesium oxide-containing layer, the magnesium oxide-containing particles having a magnesium vacancy impurity center (VIC), the magnesium oxide containing particles comprising a rare earth element as the impurity forming the magnesium VIC and inducing a transition between a state formed by the impurity of the magnesium VIC and another state formed by a magnesium vacancy, the magnesium oxide-containing particles being formed in a regular pattern.

10. The method of claim 9, wherein the attaching of the magnesium oxide-containing particles to the magnesium oxide-containing layer comprises:

applying a mixture of the magnesium oxide particles and a solvent to a surface of the magnesium oxide-containing layer; and performing heat treating of the applied mixture.

11. The method of claim 10, wherein the solvent comprises at least one of ethanol and isopropanol.

12. The method of claim 10, wherein the heat treating is performed at a temperature of 80° C. to 350° C.

13. A plasma display panel comprising:

a first substrate;

a second substrate facing the first substrate;

a plurality of barrier ribs which define discharge cells and which are disposed between the first substrate and the second substrate;

address electrodes which extend in a first direction along the discharge cells and which are covered by a second dielectric layer;

sustain electrodes which extend in a second direction perpendicular to the first direction and which are covered by a first dielectric layer;

a protecting layer formed on the first dielectric layer or on the second dielectric layer, the protecting layer comprising:

a magnesium oxide-containing layer, the magnesium oxide-containing layer including an element selected from the group consisting of Al, Ca, and Si; and magnesium oxide-containing particles formed on a surface of the magnesium oxide-containing layer, the magnesium oxide-containing particles having a magnesium vacancy-impurity center (VIC), the magnesium oxide containing particles comprising a rare earth element as the impurity forming the magnesium VIC and inducing a transition between a state formed by the impurity of the magnesium VIC and another state formed by a magnesium vacancy, the magnesium oxide-containing particles being formed in a regular pattern;

a phosphor layer formed inside the discharge cells; and a discharge gas filling the discharge cells.

14. A plasma display panel of claim 13, wherein a cathodoluminescence (CL) emission spectrum of the magnesium oxide-containing particles has a peak from VIC in the range of 3.1 eV to 6 eV.

15. A plasma display panel of claim 13, wherein a cathodoluminescence (CL) emission spectrum of the magnesium oxide containing particles has a peak from VIC in the range of 3.1 eV to 4.2 eV.

16. A plasma display panel of claim 13, wherein a cathodoluminescence (CL) emission spectrum of the magnesium oxide containing particles has a peak from VIC in the range of 3.35 eV to 3.87 eV.

17. A plasma display panel of claim 13, wherein the magnesium oxide-containing layer further comprises a rare-earth element.

18. A plasma display panel of claim 13, wherein the magnesium oxide containing particles further comprise scandium (Sc).

19. A plasma display panel of claim 13, wherein the magnesium oxide-containing particles further comprise an element selected from the group consisting of Al, Ca, and Si.

* * * * *